US006011347A

United States Patent [19]

Wittmann

[11] Patent Number: 6,011,347

[45] Date of Patent: Jan. 4, 2000

[54] COMPACT LOW-PRESSURE DISCHARGE LAMP UTILIZING HELICAL OR SPIRAL SPRINGS TO CONNECT THE SUPPLY LEADS OF THE LAMP ENVELOPE TO THE ELECTRIC TERMINALS WITHIN THE LAMP CAP

[75] Inventor: Horst Wittmann, Stadtbergen, Germany

[73] Assignee: Patent-Treuhand-Gesellschaft Fuer Elektrische Gluehlampen GmbH, Munich, Germany

[21] Appl. No.: 09/006,723

[22] Filed: Jan. 14, 1998

[30] Foreign Application Priority Data

Jan. 15, 1997 [DE] Germany ..... 197 01 162

[51] Int. Cl.[7] ..... H01J 5/48; H01J 5/50; H01J 1/62; H01J 63/04

[52] U.S. Cl. ..... 313/318.09; 313/493; 313/634; 439/236

[58] Field of Search ..... 313/318.01, 318.03, 313/318.04–318.06, 318.09, 318.1, 318.12, 493, 492, 573–74, 631–32, 634; 362/217, 219, 238, 249, 282, 322, 312; 439/236, 840, 565, 553, 556, 56, 620, 699.2, 398, 419, 397, 399–400, 918

[56] References Cited

U.S. PATENT DOCUMENTS

| | | | |
|---|---|---|---|
| 3,775,731 | 11/1973 | Merki et al. | 439/556 |
| 4,572,601 | 2/1986 | Jones et al. | 439/180 |
| 4,578,741 | 3/1986 | Prohaska et al. | 362/544 |
| 4,597,035 | 6/1986 | Lettenmeyer | 362/219 |
| 4,937,487 | 6/1990 | Blaisdell et al. | 313/318.09 |
| 5,063,486 | 11/1991 | Cummings, III et al. | 362/217 |
| 5,389,010 | 2/1995 | Takano et al. | 439/565 |
| 5,397,251 | 3/1995 | Kaminski | 439/620 |
| 5,647,761 | 7/1997 | Kaminski | 439/419 |

FOREIGN PATENT DOCUMENTS 0 452 743 A1 10/1991 European Pat. Off. .

*Primary Examiner*—Nimeshkumar D. Patel
*Assistant Examiner*—Mack Haynes
*Attorney, Agent, or Firm*—Carlo S. Bessone

[57] ABSTRACT

The invention relates to a compact low-pressure discharge lamp comprising a discharge vessel 14 having electrodes and supply leads 30, and having a lamp cap 12 assembled from a cap 16, housing 18 and mounting plate 24 with a ballast arrangement. In this case, the mounting plate 24 with the ballast arrangement 32 is fitted in the interior of the lamp cap housing 18. The mounting plate 24 also has terminals 26 for the electric connection of the supply leads 30. According to the invention, in this case the supply leads 30 are connected to the electric terminals 26 of the mounting plate 24 via or by means of an electrically conducting helical or spiral spring 28 in each case.

24 Claims, 6 Drawing Sheets

COMPACT LOW-PRESSURE DISCHARGE LAMP UTILIZING HELICAL OR SPIRAL SPRINGS TO CONNECT THE SUPPLY LEADS OF THE LAMP ENVELOPE TO THE ELECTRIC TERMINALS WITHIN THE LAMP CAP

BACKGROUND OF THE INVENTION

The invention relates to a compact low-pressure discharge lamp comprising a discharge vessel having electrodes and supply leads and having a lamp cap assembled from a cap, housing and mounting plate with a ballast arrangement, the mounting plate with the ballast arrangement being fitted in the interior of the lamp cap housing and having terminals for the electrical connection of the supply leads to the mounting plate.

Known low-pressure discharge lamps are increasingly replacing the incandescent lamp in buildings and residential accommodation. In the known low-pressure discharge lamps, the discharge vessel mostly comprises a singly or multiply bent tube which is arranged in a lamp cap. In this case, a mounting plate constructed as a printed circuit board and on which there is soldered an electronic ballast arrangement is integrated in the lamp cap. Production costs for these compact low-pressure discharge lamps are relatively high, since many complicated manufacturing steps are required in the production. One of these manufacturing steps is the electrical connection between the supply leads of the discharge vessel and the corresponding terminals of the ballast arrangement. In order to produce this connection, the appropriate connecting wires are presently being brought together and, for example, crimped by means of a metal sleeve.

A development of this simple connection is described in EP-A-0 452 743. This printed publication discloses a low-pressure discharge lamp of the type described at the beginning, which has holding pins with the aid of which the ends of the supply leads are aligned perpendicular to the bow-shaped connecting wires of the ballast arrangement. When assembling the lamp cap housing and mounting plate with the lamp cap, the wires which are respectively to make contact are arranged approximately at a right angle one behind another and pressed against one another resiliently with the aid of the holding pin and the inner wall of the lamp cap housing, with the result that an electrical connection is produced between the electrodes of the discharge vessel of the ballast arrangement.

However, it is disadvantageous in this prior art that such an electric connecting system is very complicated. This increases the production costs. In addition, in order to ensure reliable contacting of the elements, the rate of production for such low-pressure discharge lamps is not very high. The multiplicity of components additionally produces problems of space inside the lamp housing. It is therefore not possible, for example, to reduce the size of the housing.

SUMMARY OF THE INVENTION

It is therefore the object of the invention to provide a compact low-pressure discharge lamp of the type mentioned at the beginning in which the structure required for an electrical connection between the supply leads of the discharge vessel and the corresponding terminals of the ballast arrangement can be produced simply, in a space saving fashion, quickly and cost effectively while ensuring optimum contact reliability.

The features of the independent claim serve to achieve this object.

Advantageous embodiments are described in the subclaims.

In a compact low-pressure discharge lamp according to the invention, the supply leads of a discharge vessel are connected to the electric terminals of a mounting plate with a ballast arrangement via or by means of an electrically conducting helical or spiral spring in each case. The use of a helical or spiral spring which on the one hand bears against in each case one supply lead and the corresponding electric terminal of the mounting plate, or on the other hand presses the supply lead against the corresponding electric terminal, ensures reliable contact is made. Thus, when assembling the lamp cap housing and mounting plate with the lamp cap, the respective springs are pressed against both the supply leads and the electric terminals of the mounting plate or the springs press the supply leads directly against the corresponding terminals. According to the invention, only one element is therefore advantageously required to connect the supply leads of the discharge vessel to the corresponding terminals of the mounting plate or of the ballast. The production costs are thereby reduced substantially. In addition, this advantageously results in a substantial increase in the rate of production, since when assembling the lamp cap of the low-pressure discharge lamp the lamp cap housing and lamp cap need only be pressed against one another. Moreover, more space is available for possible further components due to the space-saving method of making contact. It is also advantageously possible to reduce the size of the entire lamp housing.

Before assembling the lamp cap, according to the invention the helical or spiral spring is received in a spring receptacle constructed on the inner circumference of the cap. For this purpose, the spring receptacle has a cavity, formed by a side wall normally of circular construction in cross-section, for receiving at least one part of the spring. As a result, the springs can be mounted independently of the final assembly of the lamp, and this contributes to simplifying the production method and thus lowers the production costs. Moreover, it is thereby ensured that the lamp or the electronics section, that is to say, in particular, the mounting plate with ballast arrangement, can be easily reused. In addition to an advantageous functional testing of the lamp and electronics section which can be carried out separately, it is also possible for these components to be disposed of separately without any problem.

In a further advantageous embodiment of the low-pressure discharge lamp according to the invention, the side wall has two parallel, opposite slots open towards the free end of the spring receptacle, for receiving the supply lead. In this case, a shoulder is constructed in the cap in the region of the cap-side slot. This serves to support an end of the supply lead. According to the invention, these features also contribute to simplifying the production process. Thus, before the final assembly of the lamp cap with the lamp cap housing, the respective end of the supply leads of the discharge vessel is laid in the open slots of the side wall of the spring receptacle and on the shoulder. If, now, the spring is placed onto the end of the supply lead, it presses the end of the supply lead into the cavity of the spring receptacle and into a cavity which surrounds the shoulder, the supply lead coming to lie on the shoulder and in the slot of the spring receptacle. Since the other end of the spring is held down by the mounting plate, a simple and reliable electric contact is ensured between the helical or spiral spring and the supply lead, on the one hand, and the corresponding electric terminals on the mounting plate.

In a further advantageous embodiment of the low-pressure discharge lamp according to the invention, the springs are likewise received by corresponding spring receptacles constructed on the inner circumference of the cap. For this purpose, the spring receptacles likewise have a cavity for receiving at least one part of the spring, which cavity is formed by the side wall, which is usually of circular construction in cross-section. However, in this exemplary embodiment the side wall of the spring receptacle is constructed in a lengthened fashion in a subregion in such a way that the end of the subregion projects beyond the mounting plate or through into the region of the ballast arrangement, a slot being formed in the subregion for the purpose of receiving the supply lead. According to the invention, these features also contribute to simplifying the production process of the lamp. Thus, before the final assembly of the lamp cap with the lamp cap housing, the respective end of the supply leads of the discharge vessel is laid and pressed into the open slot in the lengthened subregion of the side wall of the spring receptacle. If the spring is now placed onto the end of the supply lead, it presses the end of the supply lead onto the electric terminal of the mounting plate. The result is that a simple and reliable electrical connection between the supply lead and the corresponding electric terminals on the mounting plate is ensured.

The length of the helical or spiral spring is, in addition, selected so as to ensure a reliable contact between the supply lead and the terminal of the mounting plate.

The helical or spiral spring usually consists of a metal alloy which is a good conductor. Additional tinplating of the springs is possible.

In a further advantageous embodiment of the subject-matter of the invention, the supply lead and the spring are constructed in one piece. Since this reduces the number of the elements which make the electrical connection, a further simplification of the production process is possible.

In a further advantageous embodiment of the low-pressure discharge lamp according to the invention, the mounting plate is fastened perpendicular to the longitudinal lamp axis in the interior of the housing. In this case, the mounting plate rests on ribs which are constructed on the inner circumference of the housing and run parallel to the longitudinal lamp axis. The mounting plate is advantageously constructed as a printed circuit board, conductor tracks being constructed on the side facing the discharge vessel, and circuit elements of the ballast arrangement being constructed on the side averted from the discharge vessel. In this case, at least one terminal is constructed as a soldering eyelet for the purpose of making electric contact between the supply lead and the mounting plate. In a further advantageous embodiment, at least one terminal comprises one or more flat soldering surfaces and/or solder tag strips for the purpose of making electric contact between the supply lead and the mounting plate. This simple and space saving structure of the lamp cap ensures that said cap can be kept small overall and can also be produced cost effectively.

Positioning devices are advantageously constructed for positioning the cap and the housing of the lamp cap in the correct position.

BRIEF DESCRIPTION OF THE DRAWINGS

Further details, features, embodiments and advantages result from the following description of a plurality of exemplary embodiments of the subject-matter of the invention, which are represented by drawings, in which.

BEST MODE FOR CARRYING OUT THE INVENTION

Figure 1:
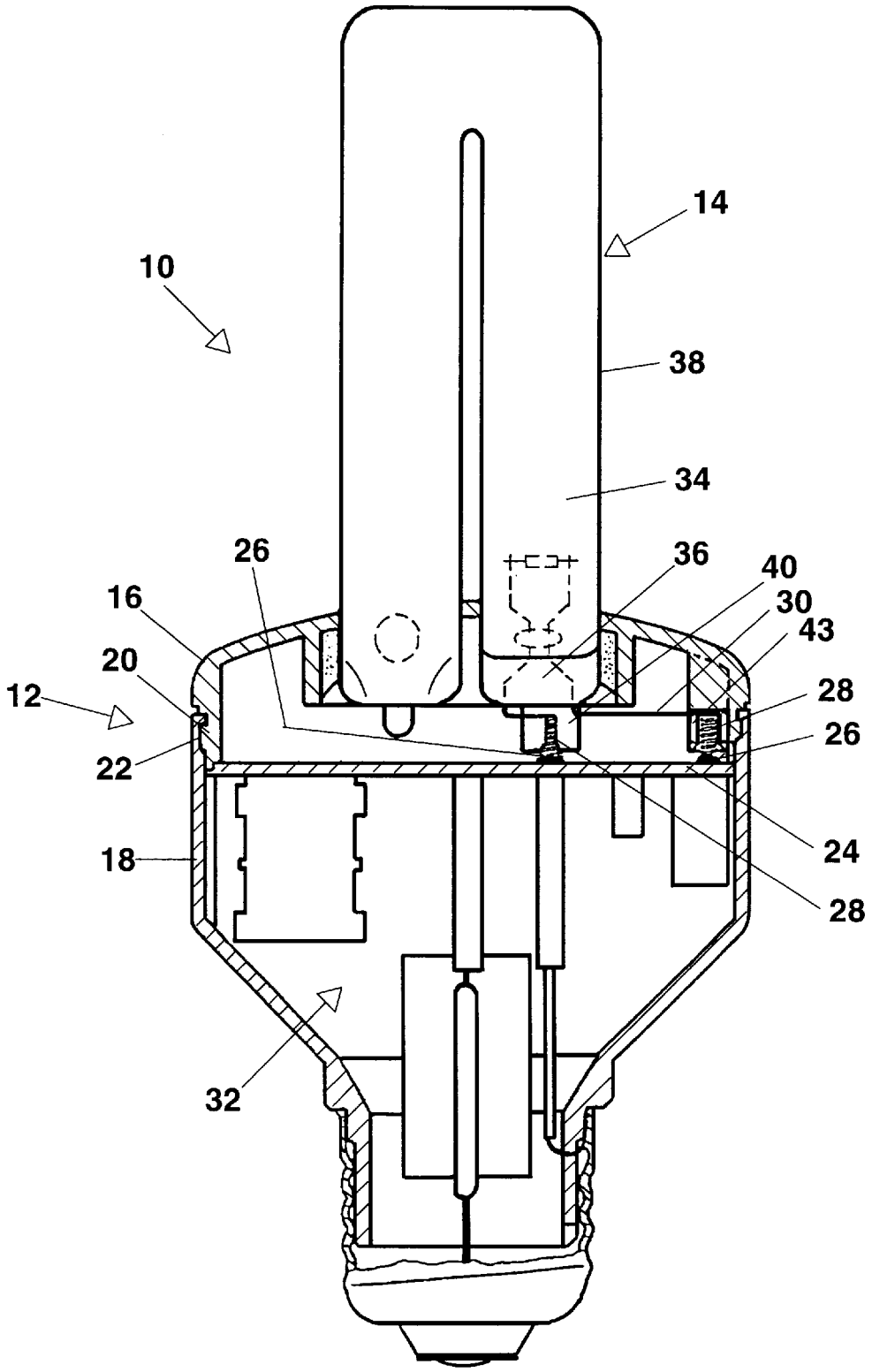
FIG. 1 shows a diagrammatically represented, partially sectioned side view of the low-pressure discharge lamp according to the invention.

Reproduced in FIG. 1 is a partially sectioned side view of a compact low-pressure discharge lamp 10 according to the invention. The lamp 10 comprises in this case a discharge vessel 14 and a lamp cap 12, the lamp cap 12 being assembled from a cap 16 and a housing 18. The lamp cap 12 is constructed in this case essentially in the shape of a cylinder. The cap 16 and the housing 18 are detachably interconnected, at least one positioning device (not represented) being constructed for connecting the cap 16 and the housing 18 in the correct position. In this case, in the end facing the housing 18 the cap 16 has an annular bead 20 in its outer circumference. The bead 20 engages in this case in a corresponding annular groove 22 in the inner circumference of the housing 18. A secure connection between the two parts is produced by snapping the inner edge of the housing 18 onto the outer edge of the cap 16.

In the interior of the housing 18, which is essentially of cylindrical construction, a mounting plate 24 is fastened perpendicular to the longitudinal lamp axis. The mounting plate 24 is constructed as a printed circuit board, conductor tracks being constructed on the side facing the discharge vessel 14, and circuit elements of the ballast arrangement 32 being constructed on the side averted from the discharge vessel 14. In addition, constructed on the inner circumference of the housing 18 are ribs 58 which run parallel to the longitudinal lamp axis and on whose ends the mounting plate 24 rests.

The discharge vessel 14 normally comprises two or three tube lengths bent in the shape of a U, which are interconnected by a passage, the end limbs respectively supporting electrodes. The free ends of the tube lengths 38 or of the bulbs 34 are sealed in a gas tight fashion by pinches 36 and are seated inside the cap 16 of the lamp cap 12. Supply leads 30 emerge from the discharge vessel 14 in the region of the pinches 36. The supply leads 30 are connected to the electric terminals 26 of the mounting plate 24 via an electrically conducting helical or spiral spring 28 in each case. The spring 28 engages in this case in a spring receptacle 40 constructed on the inner circumference of the cap 16, and is fastened detachably therein in the exemplary embodiment shown.

The spring receptacle 40 comprises a side wall 43 which is approximately of circular construction in cross-section and surrounds a cavity 42. The cavity 42 serves to receive a part of the spring 28.

Figure 2:
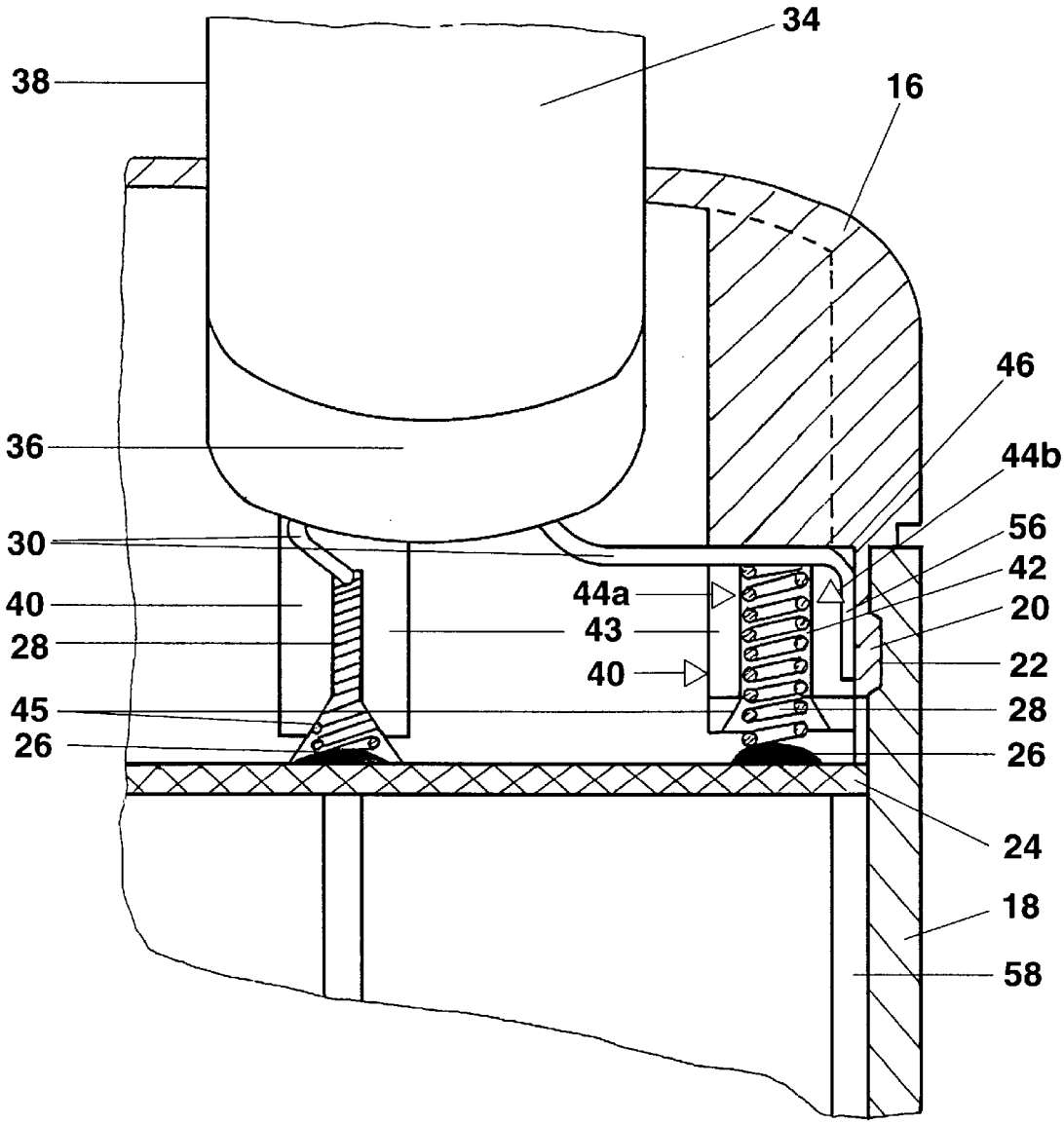
FIG. 2 shows a diagrammatically represented, partially sectioned detailed side view of the low-pressure discharge lamp according to the invention.

FIG. 2 shows a diagrammatically represented, partially sectioned detailed side view of the low-pressure discharge lamp 10. It is to be seen that the helical or spiral spring 28 for the contact closure comes to lie between the supply lead 30 and the terminal 26. The supply leads 30 normally comprise two components, specifically Vakuvit and galvanized wire, and have a diameter of approximately 0.4 mm. The side wall 43 has two parallel opposite slots 44*a*, 44*b*, open towards the free end of the spring receptacle 40, for receiving the supply lead 30. A shoulder 46 is constructed in the cap 16 in the region of the cap-side slot 44*b*. It serves to support an end 56 of the supply lead 30 that is pressed, during assembly of the cap 16 with the housing 18, against the inner circumference of the cap 16 and the cavity constructed there.

In addition, the side wall 43 surrounding the cavity 42 has bevels 45 towards the free end of the spring receptacle 40. These bevels 45 facilitate the insertion of the spring 28 and of the supply lead 30.

It is to be seen, furthermore, that on the side facing the discharge vessel 14 the mounting plate 24 has terminals 26 for making electric contact with the supply leads 30 of the ballast arrangement 32. The terminals 26 can be constructed in this case as a soldering eyelet or else as flat soldering surfaces or solder tag strips integrated into the mounting plate 24.

Figure 3:
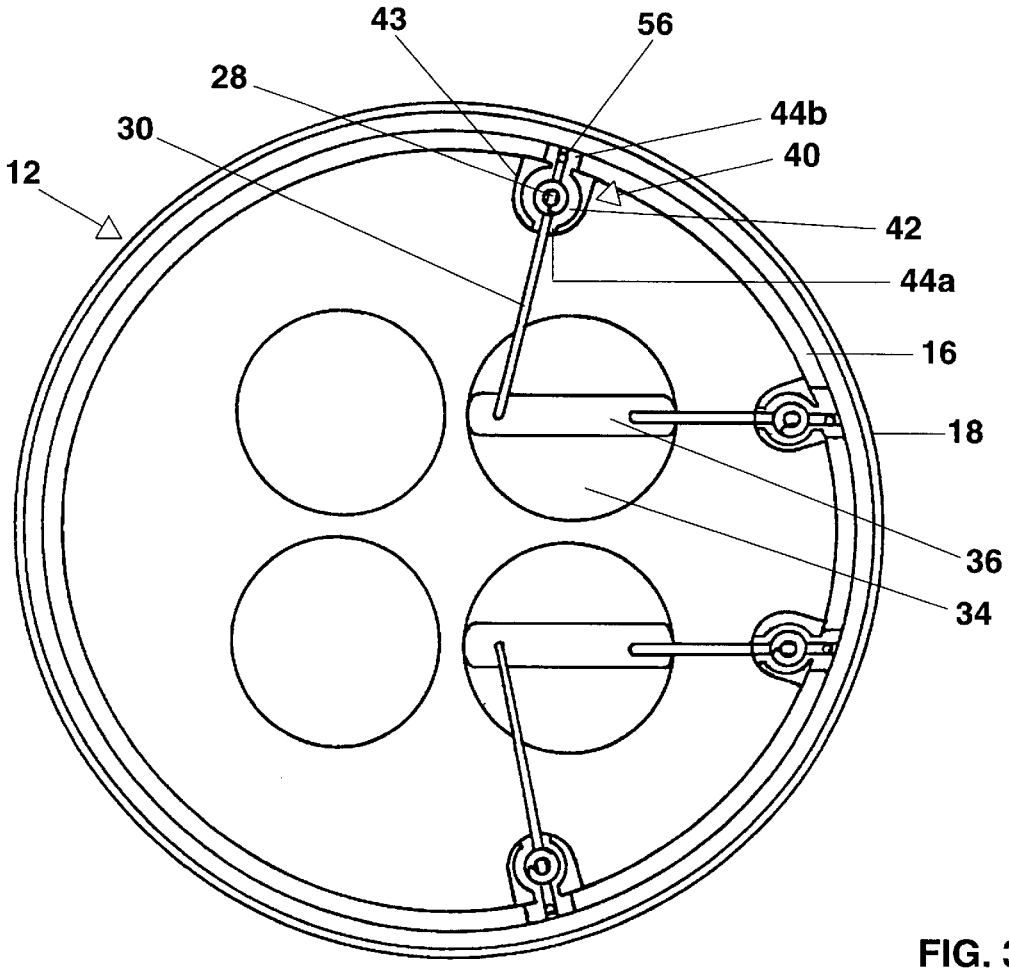
FIG. 3 shows a diagrammatically represented top view of the lamp cap of the low-pressure discharge lamp according to the invention.
Figure 4:
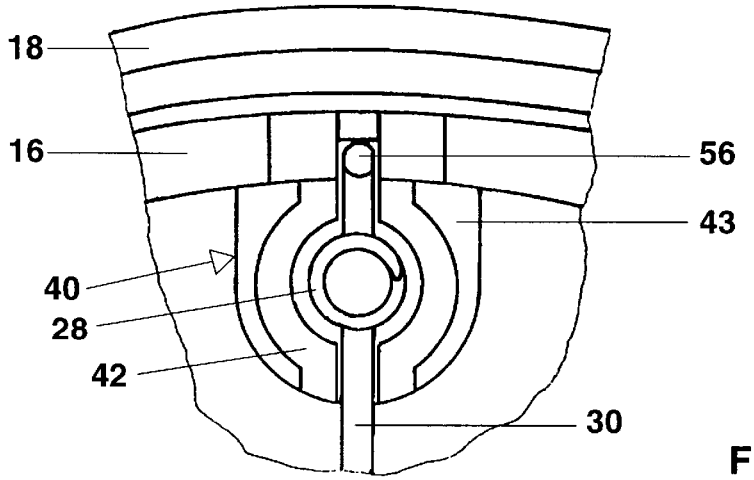
FIG. 4 shows a diagrammatically represented top view of a part of the edge region of the lamp cap of the low-pressure discharge lamp according to the invention.

A top view of the lamp cap 12 of the low-pressure discharge lamp 10 is represented in FIGS. 3 and 4. It is to be seen that the free end of the housing 18 is connected to the free end of the cap 16. The spring receptacles 40 are constructed on the inner circumference of the cap 16. The spring receptacle 40 is in this case of essentially circular construction in cross-section. The parallel position, with the same axis, of the slots 44*a* and 44*b* is also well in evidence. In addition, it is made clear that the spring 28 rests on the supply lead 30. The supply lead 30 is guided in the slots 44*a* and 44*b*, the end 56 of the supply lead 30 resting on the shoulder 46 and being pressed into a cavity, constructed in the cap 16, against the inner circumference of the cap 16.

Figure 5:
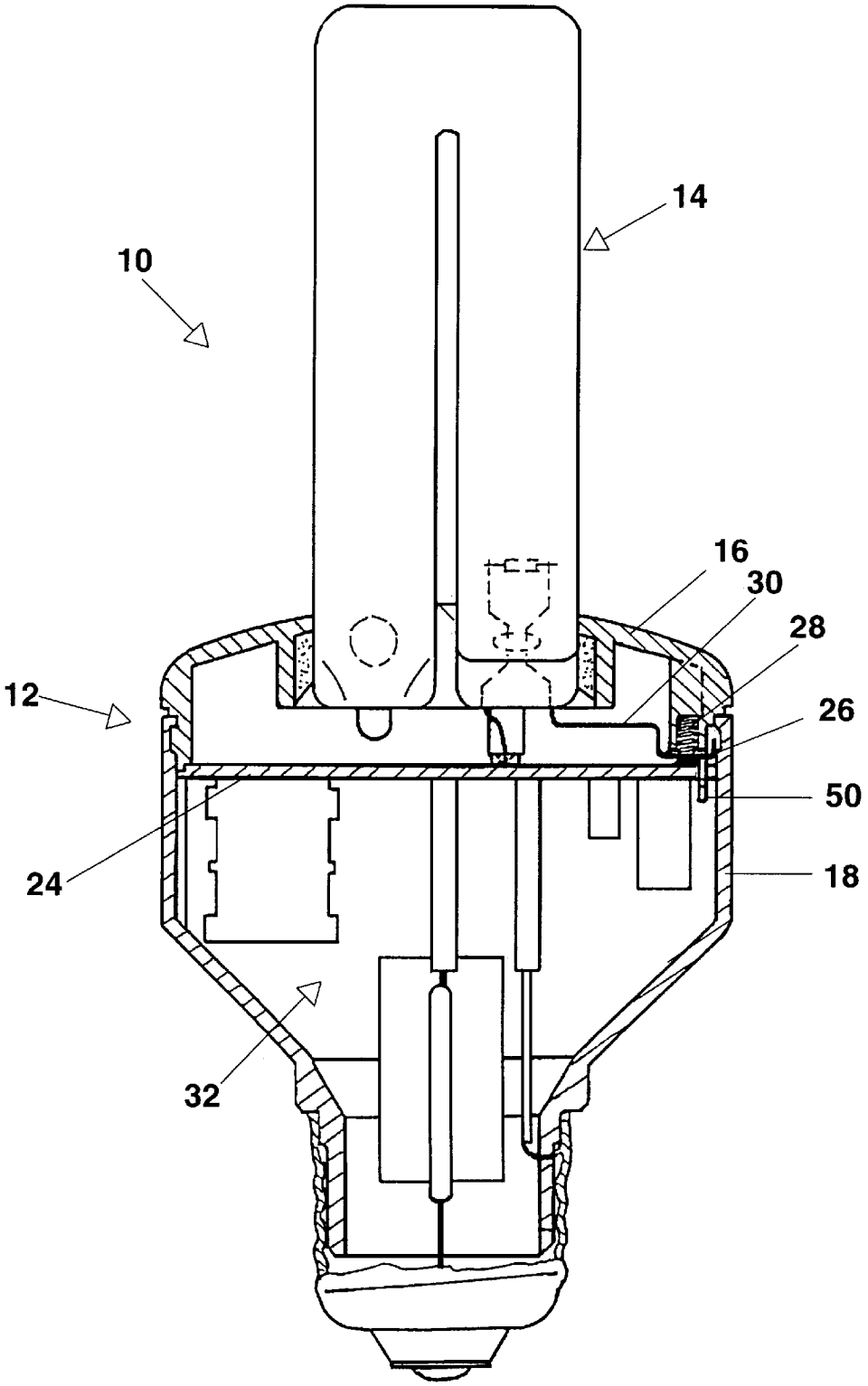
FIG. 5 shows a diagrammatically represented, partially sectioned side view of a second embodiment of the low-pressure discharge lamp according to the invention.

FIG. 5 shows a diagrammatically represented, partially sectioned side view of a second embodiment of the low-pressure discharge lamp 10. The structure of this lamp 10 corresponds in this case essentially to that of the one described in FIGS. 1 to 4. In the case of this exemplary embodiment, as well, spring receptacles 40 for receiving and detachably fastening the helical or spiral springs 28 are arranged on the inner circumference of the cap 16. The spring receptacles 40 also each have a cavity 42 which is constructed by a side wall 43 of approximately circular construction in cross-section. By contrast with the embodiment first described, the helical or spiral springs 28 here press the supply leads 30 directly against the corresponding electric terminals 26 of the mounting plate 24.

Figure 6:
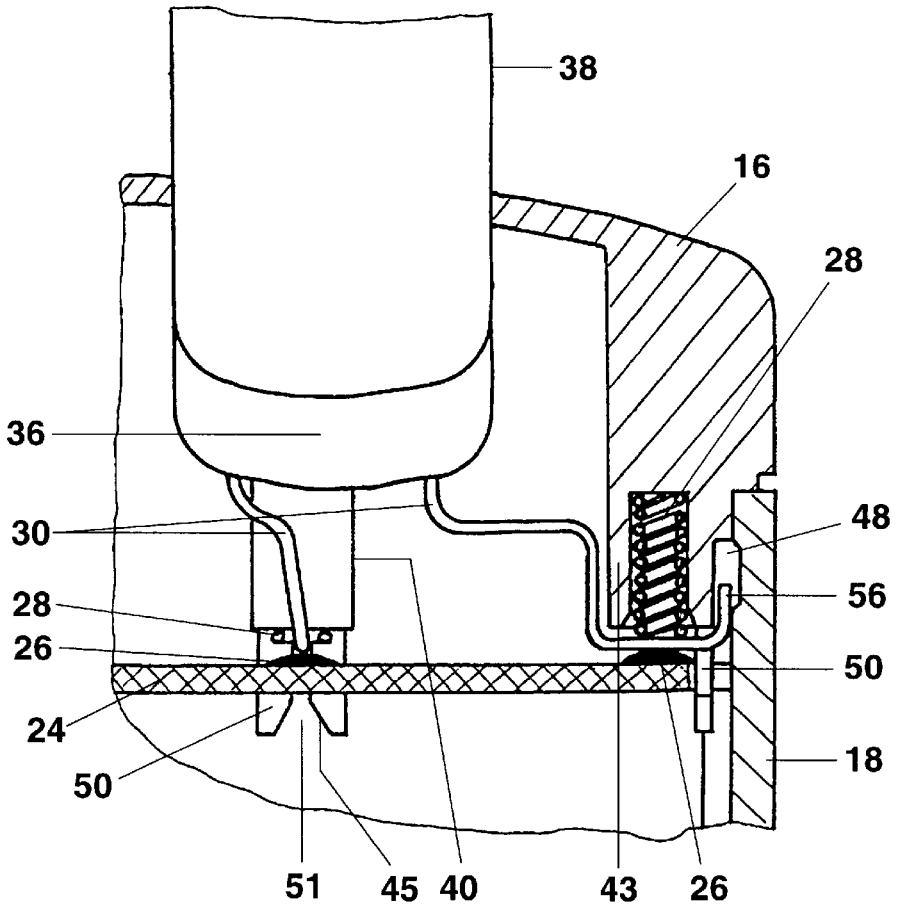
FIG. 6 shows a diagrammatically represented, partially sectioned detailed side view of the low-pressure discharge lamp in accordance with FIG. 5.
Figure 7:
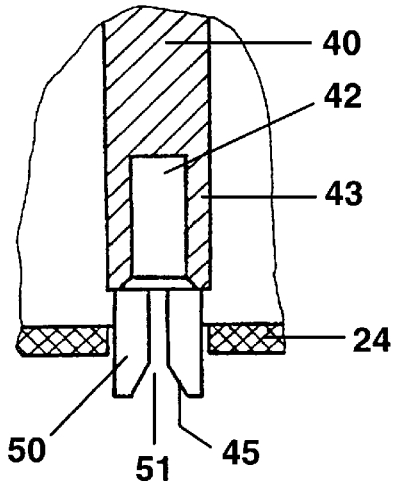
FIG. 7 shows a diagrammatically represented, detailed view of the edge region of the low-pressure discharge lamp according to the invention, in accordance with FIG. 5.

The detailed representations in accordance with FIGS. 6 and 7 show that the side wall 43 of the spring receptacle 40 is constructed in a lengthened fashion in a subregion 50 in such a way that the end of the subregion 50 of the side wall 43 projects beyond the mounting plate 24 or through into the region of the ballast arrangement 32, a slot 51 being formed in the subregion 50 for the purpose of receiving the supply lead 30. When assembling the lamp cap 16 with the lamp cap housing 18, the respective end of the supply leads 30 of the discharge vessel 14 is laid and pressed into the open slot 51 of the lengthened subregion 50 of the side wall 43 of the spring receptacle 40. The spring 28 then presses the end of the supply lead 30 onto the electric terminal 26 of the mounting plate 24. The terminals 26 can here also be constructed as a soldering eyelet or else as flat soldering surfaces and/or solder tag strips integrated into the mounting plate 24. The insertion of the supply lead 30 into the slot 51 is facilitated by corresponding bevels 45 of the side wall 50 on the free end of the spring receptacle 40. Furthermore, it is to be seen that a gap 48 is constructed between the inner circumference of the housing 18 and the spring receptacle 40. The gap 48 serves to receive the end 56 of the supply lead 30.

Figure 8:
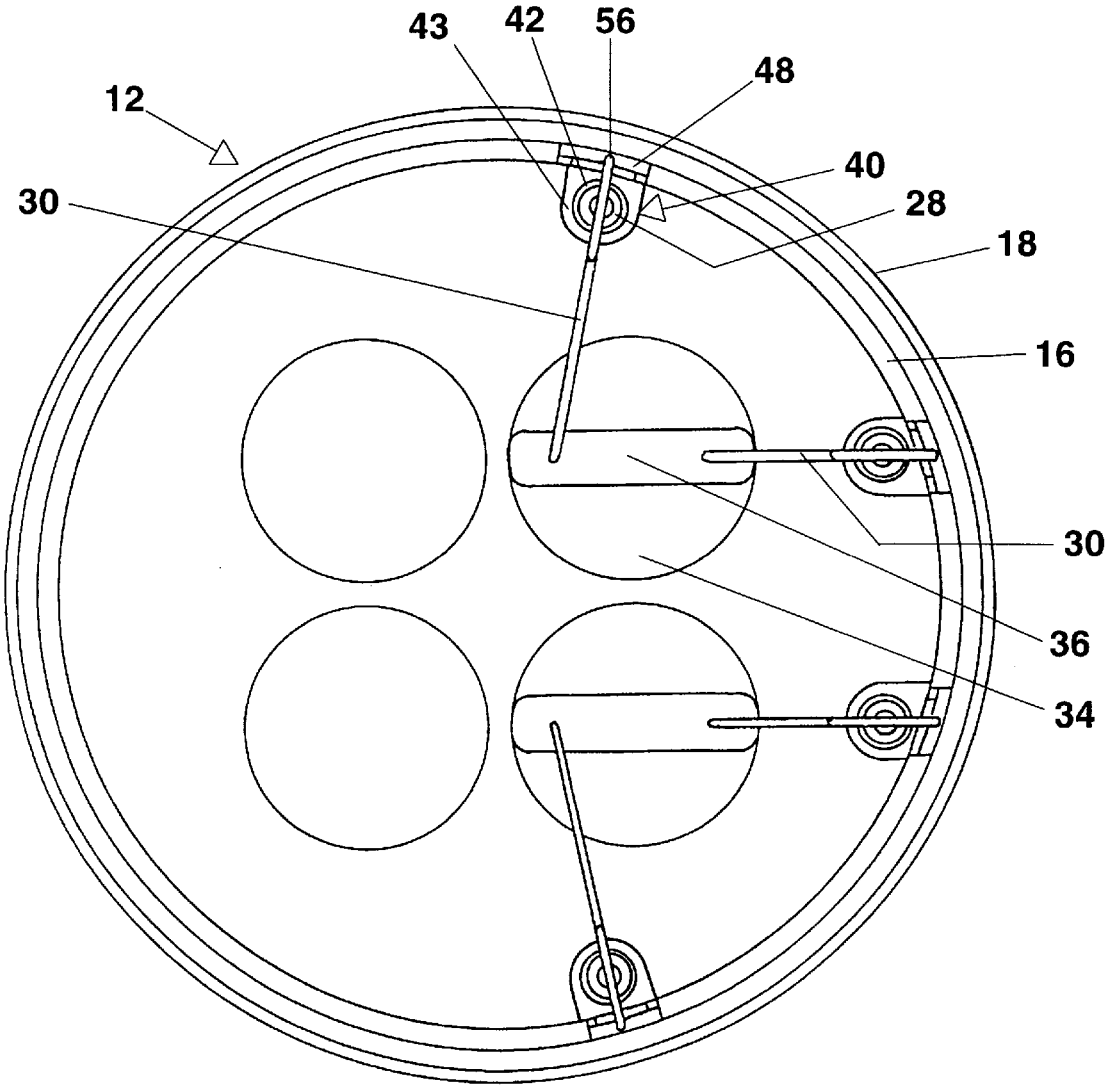
FIG. 8 shows a diagrammatically represented top view of the lamp cap of the low-pressure discharge lamp according to the invention, in accordance with FIG. 5.

FIG. 8 represents a top view of the lamp cap 12 of the low-pressure discharge lamp 10. It is to be seen that the free end of the housing 18 is connected to the free end of the cap 16. The spring receptacles 40 are constructed on the inner circumference of the cap 16. The spring receptacles 40 are in this case of essentially circular construction in cross-section. It becomes clear, in addition, that the supply leads 30 in each case rest on the free ends of the spring receptacles 40. The supply lead 30 is guided in the slot 51, the end 56 of the supply lead 30 coming to lie in the gap 48.

The springs 28 used consist predominantly of a metal alloy which is a good conductor. In addition, the spring 28 can be at least partly tin-plated and/or galvanized. The lead of the helical or spiral spring 28 is smaller than the diameter of the spring.

In a further exemplary embodiment (not represented), it is provided that the supply lead 30 and the spring 28 are constructed in one piece.

I claim:

1. A compact low-pressure discharge lamp comprising a discharge vessel (14) having electrodes and supply leads (30) and having a lamp cap (12) assembled from a cap (16), housing (18) and mounting plate (24) with a ballast arrangement (32), the mounting plate (24) with the ballast arrangement (32) being fitted in the interior of the lamp cap housing (18) and having terminals (26) for the electric connection of the supply leads (30) to the mounting plate (24), characterized in that the supply leads (30) are connected to the electric terminals (26) of the mounting plate (24) via or by means of an electrically conducting helical or spiral spring (28) in each case.

2. The low-pressure discharge lamp according to claim 1, characterized in that the helical or spiral spring (28) for contact closure comes to lie between the supply lead (30) and the terminal (26).

3. The low-pressure discharge lamp according to claim 1, characterized in that the helical or spiral spring (28) for contact closure presses the supply lead (30) against the terminal (26).

4. The low-pressure discharge lamp according to claim 2, characterized in that the cap (16) has at least one spring receptacle (40) for receiving and detachably fastening the helical or spiral spring (28).

5. The low-pressure discharge lamp according to claim 4, characterized in that the spring receptacle (40) is constructed on the inner circumference of the cap (16).

6. The low-pressure discharge lamp according to claim 4 or 5, characterized in that the spring receptacle (40) has a cavity (42) for receiving a part of the helical or spiral spring (28), which cavity is constructed by a side wall (43) of circular cross-section.

7. The low-pressure discharge lamp according to claim 6, characterized in that the side wall (43) has two parallel, opposite slots (44*a*, 44*b*), open towards the free end of the spring receptacle (40), for receiving the supply lead (30).

8. The low-pressure discharge lamp according to claim 7, characterized in that in the region of the slot (44*b*) a shoulder (46) is constructed in the cap (16) for supporting an end (56) of the supply lead (30).

9. The low-pressure discharge lamp according to claim 3, characterized in that the cap (16) has at least one spring receptacle (40) for receiving and detachably fastening the helical or spiral spring (28).

10. The low-pressure discharge lamp according to claim 9, characterized in that the spring receptacle (40) is constructed on the inner circumference of the cap (16).

11. The low-pressure discharge lamp according to claim 9 or 10, characterized in that the spring receptacle (40) has a cavity (42) for receiving a part of the helical or spiral spring (28), which cavity is constructed by a side wall (43) of circular cross-section.

12. The low-pressure discharge lamp according to claim 9, characterized in that a gap (48) for receiving an end (56) of the supply lead (30) is constructed between the inner circumference of the housing (18) and the spring receptacle (40).

13. The low-pressure discharge lamp according to one of the preceding claim 11, characterized in that the side wall (43) of the spring receptacle (40) is constructed in a lengthened fashion in a subregion (50) in such a way that the end of the subregion (50) of the side wall (43) projects beyond the mounting plate (24) or through into the region of the ballast arrangement (32), a slot (51) being formed in the subregion (50) for the purpose of receiving the supply lead (30).

14. The low-pressure discharge lamp according to claim 13, characterized in that the side wall (43) surrounding the cavity (42) has bevels (45) towards the free end of the spring receptacle (40).

15. The low-pressure discharge lamp according to claim 1, characterized in that the spring (28) consists of a metal alloy which is a good conductor.

16. The low-pressure discharge lamp according to claim 1, characterized in that the length of the spring (28) is selected so as to ensure reliable contact with the terminal (26) of the mounting plate (24).

17. The low-pressure discharge lamp according to claim 1, characterized in that the lamp cap (12) is essentially of cylindrical construction.

18. The low-pressure discharge lamp according to claim 1, characterized in that the cap (16) and the housing (18) are detachably connected to one another, at least one positioning device being constructed for connecting the cap (16) and housing (18) in the correct position.

19. The low-pressure discharge lamp according to claim 1, characterized in that the mounting plate (24) is fastened perpendicular to the longitudinal lamp axis in the interior of the housing (18).

20. The low-pressure discharge lamp according to claim 1, characterized in that constructed on the inner circumference of the housing (18) are ribs (58) which run parallel to the longitudinal lamp axis and on whose ends the mounting plate (24) rests.

21. The low-pressure discharge lamp according to claim 1, characterized in that the mounting plate (24) is constructed as a printed circuit board, conductor tracks being constructed on the side facing the discharge vessel (14), and circuit elements of the ballast arrangement being constructed on the side averted from the discharge vessel (14).

22. The low-pressure discharge lamp according to claim 1, characterized in that at least one terminal (26) is constructed as a soldering eyelet for the purpose of making electric contact between the supply leads (30) and the mounting plate (24).

23. The low-pressure discharge lamp according to claim 1, characterized in that at least one terminal (26) comprises one or more flat soldering surfaces and/or solder tag strips for the purpose of making electric contact between the supply leads (30) and the mounting plate (24).

24. The low-pressure discharge lamp according to claim 1, characterized in that the supply lead (30) and the spring (28) are constructed in one piece.

* * * * *